United States Patent [19]

Korsakov-Bogatkov et al.

[11] 4,161,107

[45] Jul. 17, 1979

[54] METHOD OF PRODUCING SUPERCOLD TEMPERATURE IN CRYOGENIC SYSTEMS

[76] Inventors: Sergei M. Korsakov-Bogatkov, 5 Parkovaya ulitsa, 56/6, kv. 74; Boris D. Krakovsky, Narodnaya ulitsa, 13, kv. 136; Vasily D. Nikitkin, Tsvetnoi bulvar, 25, kv. 95; Evgeny V. Onosovsky, ulitsa Z. i A. Kosmodemyanskikh, 8/7, kv. 131; Vladimir G. Pronko, B. Kozlovsky pereulok, 11, kv. 42; Leonid M. Stolper, Krasnobogatyrskaya ulitsa, 21, kv. 136; Boris A. Chernyshev, Smolenskaya naberezhnaya, 2, kv. 16, all of Moscow, U.S.S.R.

[21] Appl. No.: 773,414

[22] Filed: Mar. 1, 1977

[30] Foreign Application Priority Data

Mar. 3, 1976 [SU] U.S.S.R. ..... 2323651[I]

[51] Int. Cl.[2] ..... F25B 9/00

[52] U.S. Cl. ..... 62/117; 62/402; 62/39

[58] Field of Search ..... 62/9, 38, 39, 40, 402, 62/87, 401, 117

[56] References Cited

U.S. PATENT DOCUMENTS

| | | | |
|---|---|---|---|
| 3,250,079 | 5/1966 | Davis et al. | 62/40 |
| 3,613,387 | 10/1971 | Collins | 62/38 |
| 3,864,926 | 2/1975 | Collins | 62/38 |

*Primary Examiner*—Norman Yudkoff

*Attorney, Agent, or Firm*—Haseltine, Lake & Waters

[57] ABSTRACT

A method of producing supercold temperature in cryogenic systems by compressing a gaseous fluid constituting an incoming stream followed by its stepwise cooling by a return stream of the fluid. The incoming stream is split into a main stream and a subsidiary stream which is used to compensate for the losses in the system on being expanded with the removal of energy. The main stream is expanded and liquefied in a liquefaction stage. At least a portion of the subsidiary stream, on being expanded with the removal of energy, is introduced into the liquefaction stage, liquefied therein and used to sustain a refrigerative load. After that, the liquid fluid formed is used to sustain the refrigerative load and is evaporated as a consequence. The vapor forms the return stream which is passed through the cooling stages and the liquefaction stage in the reverse direction. In realizing the method disclosed, the cooling of the incoming stream in the liquefaction stage is associated with energy losses which are by far smaller than ever before.

2 Claims, 6 Drawing Figures

METHOD OF PRODUCING SUPERCOLD TEMPERATURE IN CRYOGENIC SYSTEMS

FIELD OF THE INVENTION

The present invention relates to cryogenic technology, and more specifically to a method of producing supercold temperature in cryogenic systems. It may be used to advantage in producing supercold temperatures of the order as low as the boiling point of the working fluid circulating in the cryogenic system, particularly if this fluid is a light-weight gas such as, for example, helium or hydrogen.

The invention may find utility in liquefiers and facilities for the shipping of natural gas, in air separation plants and in other systems which either produce supercold temperatures or operate at these temperatures as this is the case in various research tools used by the physicist, in power generation, nuclear engineering, electrical engineering, biology, etc.

BACKGROUND

What is witnessed today is an increased demand for helium cryogenic systems displaying a higher than ever before performance and good economy in terms of capacity, power requirements, operational reliability and so on. This fact dominating the cryogenic scene owes its origin mainly to the rapid pace of research and development work in the field of applied cryogenics associated with the use of the phenomenon of superconductivity in creating electrical machinery, powerful magnets, power transmission lines, electronic devices and also with the use of liquid hydrogen on a large scale.

Since superconductive devices require temperatures as low as 1.5° to 15° K. for their operation and taking into account that the power requirements of cryogenic systems used to cope with great refrigerative loads amount to hundreds and thousands of kilowatts, any effort to reduce the power requirements of cryogenic systems and to modify these systems so as to improve their reliability, reduce their weight, overall dimensions, etc, is appreciated. In some cases it appears to be essential to lower the temperature level achievable in the system under the conditions of good economy.

The power requirements of a low-temperature system are commonly given as the ratio of energy consumed, mainly for driving the compressor, per unit of energy removed by the refrigerator. Both these values are commonly measured in watts, and the ratio referred to is termed as actual power requirements expressed by a dimensionless figure (W/W).

For those who are versed in the art it is known that the energy removed by the refrigerator is expressed in terms of refrigerating capacity which is the amount of heat removed by the refrigerator per unit time at the specified temperature level.

There is known a method of producing supercold temperature comprising a number of operations which will be now considered by way of example in describing a helium cryogenic system capable of producing a temperature equal to the boiling point of liquid helium which is 4.2°–4.5° K.

Gaseous helium is compessed to between 20 and 30 bars in a compressor, and the compressed helium constituting the incoming stream heading for a refrigerative load is cooled down to around 100° K. by a low-pressure return stream heading in the reverse direction, i.e., away from the refrigerative load. Next, the incoming stream is split into two streams termed the main stream and subsidiary stream. The subsidiary stream is expanded in expanders with the removal of energy and used to compensate for irreversible losses and to cool down the main stream step by step, the number of cooling stages being determined by the number of the expanders employed in expanding the subsidiary stream. Expanders are sometimes replaced by a bath with a liquid refrigerant, for example, nitrogen or any other substance whose boiling point is sufficiently low to enable the process of cooling to take place. The main stream passes through all the cooling stages and then reaches the liquefaction stage where it is additionally cooled and expanded with liquefaction.

The liquid helium is used to sustain the refrigerative load and, on removing heat, evaporizes. The vapour constitutes the return stream which flows at a temperature of 4.3°–4.5° K. in a countercurrent manner relative to the main and subsidiary streams, absorbs heat in the heat exchangers of all the stages, merges while underway with the subsidiary stream expanded in the expanders and enters the compressor at a temperature around 300° K. and under atmospheric pressure to be compressed therein. This completes the cycle which is then repeated.

In one version of the method described, the expansion of the main stream accompanied by its liquefaction in the liquefaction stage takes place due to throttling while in another version this is achieved by expansion with the removal of energy. The throttling of liquid is a process used for years, and the process of expansion into the region of saturation in an engine doing external work is referred to in "Cryogenic Engineering" by R. B. Scott, D. Van Nostrand Co. Inc., Princeton, 1959, where the author, describing by way of example a helium liquefaction system, points out all the advantages offered by the expansion process when this process is compared with the throttling process.

In the described process of producing supercold temperature, the energy consumed in compressing the gas is partly recovered in the refrigerator and is partly used to compensate for various losses, i.e., is lost with no useful purpose and contributes to gaining entropy by the helium. Termed as the losses due to the irreversibility of the process, these losses result from heat transfer at temperature gradients other than zero, from friction in the stream of helium and from other causes.

Thermodynamically recoverable in cryogenic systems are less than 20% of the energy consumed, and balance being lost in compensating for irreversible losses. The bulk of these losses are losses due to temperature difference, particularly in the region of supercold temperatures. Computations indicate that the losses incurred in the liquefaction stage are roughly at balance with the net effect, i.e., with the refrigerating capacity, and that a reduction in these losses is conducive to an increase either in the effectiveness of the method of producing supercold temperature or in the performance of the system realizing this method. The losses of energy due to the irreversibility, for example, of the process of heat exchange are betrayed by the inability of the return stream to cool down the incoming stream sufficiently low as this may be the case taking into account the temperature of the return stream. A certain amount of energy is lost due to incomplete heat transfer so that an increase of the entropy of the helium is incurred and, as a result, the incoming stream is transformed into liquid fluid fed to sustain the refrigerative load in a quantity which is smaller than this can be anticipated. This implies that the refrigerating capacity of the system is an inadequate one. The quantity of liquid fluid can be increased under the conditions of loss of energy due to the irreversibility if more energy is consumed, as this may be the case when a greater amount of gas is being compressed in the compressor. The losses due to the irreversibility of the process of heat transfer increase with the increase in the ratio of the temperature difference to the absolute temperature.

In realizing the known method of producing supercold temperature wherein preference is given to throttling as a means of expanding and liquefying, the optimum pressure to be maintained in the compressor is around 25 bars which provides for the highest refrigerating capacity of the system or for the lowest actual power requirements in producing supercold temperature. Yet, the losses due to the irreversibility of the process of heat transfer appear to be rather high in this case, being brought about in the liquefaction stage by a great difference between the temperature of the incoming stream and that of the return stream. Moreover, a loss of energy due to the irreversibility is unavoidable in the course of intermediate throttling aimed at minimizing this difference in the temperatures, the energy of the compressed gas consumed during this intermediate throttling, which reduces the pressure from 25 bars to between 3 and 5 bars, mainly for overcoming the friction in the means of throttling the Joule-Thompson valve. The main cause of all these losses is a substantial difference between the heat capacity of the incoming stream and that of the return stream in the liquefaction stage.

Even when the main stream is expanded to liquefaction with the removal of energy the losses incurred due to the irreversibility of the process of heat transfer remain to be of significant nature. As indicated in the abovementioned book by R. B. Scott, this drawback stems from the fact that even in an idealized example there does always exist a substantial between the temperatures of the incoming and return streams in the liquefaction stage, this difference being especially pronounced at the lowermost temperatures of the streams and incurring a gain in entropy by a considerable amount. This temperature difference is not influenced by the efficiency of the heat exchanger and will be present in the most ideal case, i.e., in one when the difference between the temperatures of the streams at the other end of the heat exchanger is equal to zero. When the working fluid is helium, the difference between the temperatures of the incoming or, as in the case under consideration, of the main stream fed under a pressure of 25 bars and the return system admitted under a pressure of 1.3 bar is around 1.5° K. at one end of the heat exchanger whereat the return stream is entering at a temperature of 4.5° K. This temperature difference increases to 2.5° K. toward the middle of the heat exchanger and falls to less than 0.5° K. at the opposite end of the heat exchanger. Said temperature difference of 0.5° K. is to be regarded as the maximum allowable value consistent with good effectiveness of the method of producing supercold temperature.

The disadvantage referred to above has a direct bearing on the fact that the low temperature of the return stream is utilized irrationally over the range between the boiling point, which is 4.5° K. for helium, and the temperature of the compressed stream before its expansion with liquefaction (around 6° K. for helium). This leads to a decrease in refrigerating capacity or to an increase in power requirements. A significant difference between the heat capacity of compressed main stream and that of expanded return stream aggravates the situation, said difference decreasing with a decrease in the pressure of the compressed incoming stream. In the known method, any reduction of the pressure of the fluid downstream of the compressor below 20 to 25 bars is impractical because this will impair the performance, resulting in higher actual power requirements and lower refrigerating capacity, and will lead to a substantial increase in overall dimensions of both the compressor and the system realizing the method. It is sufficient to mention that, for example, a decrease in the pressure of the fluid from 20 to 8 bars results in a refrigerating capacity which is only ½ of what is commonly obtained whereas the surface of the heat exchanger increases two-fold and the amount of the energy consumed goes up by 30%.

It stands thus to reason that, in realizing the known method, a specified refrigerating capacity is obtainable only by increasing the amount of the gas compressed or, in other words, by increasing the amount of the energy consumed. On the other hand, if the amount of the gas compressed is specified, i.e., using the compressor given, the realization of the known method provides for no other alternative than too low refrigerating capacity and high actual power requirements.

SUMMARY OF THE INVENTION

It is the main object of the present invention to provide a method of producing supercold temperature in cryogenic systems in which all the processes of expanding and cooling the compressed fluid are carried out with the least possible losses of energy due to the irreversibility of these processes.

Another object of the present invention, which is of no less importance than the main one, is to provide a method of producing supercold temperature in cryogenic systems in realizing which all the processes of expanding and cooling the compressed fluid are carried out is such a way that the system embodying the method is a very compact one.

Said objects are attained by the fact that in a method of producing supercold temperature in cryogenic systems by compressing a gaseous fluid constituting an incoming stream followed by a stepwise cooling thereof with a return stream of this fluid and by splitting the incoming stream into a main stream and a subsidiary one which, on being expanded with the removal of energy, is used to compensate for the irreversible losses in the system while the main stream is expanded and liquefied in a liquefaction stage wherefrom the liquid fluid formed is fed to sustain a refrigerative load, being consequently transformed into a vapour which forms the return stream passing through the liquefaction stage as well as through the cooling stages in the reverse direction, according to the invention at least a portion of the subsidiary stream is introduced into the liquefaction stage, on being expanded with the removal of energy, where it is liquefied and then is also fed to sustain the refrigerative load.

In realizing the method disclosed, introduced into the liquefaction stage are the main stream under a pressure of, say, 20 bars and at least a portion of the subsidiary stream which has been expanded in the cooling stages, with the removal of energy, of a pressure approaching the critical one, i.e., to 2 bars if helium is being used. In this case, the heat capacity of the main stream and that of the subsidiary stream will change in the liquefaction stage with a change in the temperature according to different laws depending on the pressure of these streams. The pressure and other parameters of the streams can be selected so that the overall heat capacity of the main and subsidiary streams changes with a change in the temperature in the same way as the heat capacity of the return stream is changing. This enables not only a more complete utilization of the low temperature of the return stream in the liquefaction stage, the temperature difference causing the heat transfer between the main and subsidiary streams on one hand and the return stream on the other hand being substantially reduced, but also an additional cooling with the liquefaction of at least a portion of the subsidiary stream. As a result, the yield of liquid helium fed to sustain the refrigerative load increases and consequently increases the refrigerating capacity with a simultaneous reduction of actual power requirements. Practically it is feasible to liquefy the entire incoming stream of helium.

It is expedient that the main stream, before being introduced into the liquefaction stage, is expanded to a pressure at least equal to the critical pressure of the gaseous fluid and the merged with that portion of the subsidiary stream which is fed into this stage.

If, for example, helium is used, the critical pressure is 2.26 bars, and the reduction of the pressure of the main stream before introducing it into the liquefaction stage is to be effected by expansion with the removal of energy in the individual cooling stages, compensating for the losses incurred therein due to the irreversibility of the processes.

The advantage of the method disclosed is manifested in this case by the pattern of changes in the heat capacity of the main flow which approaches the pattern of changes in the heat capacity of the return flow. This occurs due to the reduction in the pressure of the main stream before its introduction into the liquefaction stage and again enables a more complete utillization of the low temperature displayed by the return stream. Particularly noticeable is the advantage offered by reducing, in the method disclosed, the pressure of the main stream before its introduction into the liquefaction stage in those cases when the main stream is expanded with its liquefaction through the Joule-Thompson valve in the liquefaction stage, i.e., by throttling.

To those who specialize in the art it is not unknown that what is called the throttling effect is the phenomenon of a change in the temperature of a compressed fluid in the course of its expansion without the removal of energy, i.e., in its throttling. The throttling effect is regarded as positive when the temperature of fluid decreases after throttling and negative if the temperature increases. When helium is being expanded from a pressure of 25 bars to a pressure of 8 to 12 bars at temperatures between 5° and 10° K., the throttling effect is a negative one which brings about a reduction in the amount of the liquid formed due to expansion. To compensate for this phenomenon in the course of liquefaction of the main stream, it is necessary to maintain the pressure thereof at a level below 8 to 12 bars before throttling. A reduction in the pressure of the main stream before its introduction into the liquefaction stage is conducive, as this was pointed out earlier, to a more complete utilization of the low temperature of the return stream in the liquefaction stage.

Another advantage the method disclosed offers is that the reduction of the pressure of the main stream by expanding same with the removal of energy before introducing the stream into the liquefaction stage enables effective use of turbine expanders as a means of expanding the main stream. These expanders have proved their effectiveneess in coping with high rate-of-flow streams at comparatively low rates of expansion, i.e., under the conditons met with in expanding the main stream with the removal of energy in the cooling stages. Compared with expanders of other type, reciprocating expanders, for example, turbine expanders display by far reliability so that their use is conducive to an improved reliability of the system realizing the present invention.

An increase in the rate of flows of the streams and a reduction in the rate of expansion add to the thermodynamic efficiency of the process of expansion in turbine expanders which is a factor providing for the reduction of actual power requirements in realizing the method disclosed.

A point to be neted under the conditions of the negative throttling effect observed in reducing the pressure from 25 bars to 8–12 bars at temperatures between 5° and 10° K. is that the reduction of the pressure of the main stream to 10–12 bars before its liquefaction by expansion with the removal of energy offers one more advantage, for the expander used may meet less stringent requirements in performance and design than this is the case when the pressure of the main stream is 20 to 25 bars before its expansion. The use of a high-capacity expander is conducive to a reduction in the actual power requirements of the system.

When the main stream is being liquefied by throttling, it is preferred that the pressure of the main stream and that of the liquefied portion of the subsidiary stream are equal at the inlet into the liquefaction stage. The streams under equal pressure can be merged so that the design of the heat exchangers used in the liquefaction stage is simplified and the number of means of expansion is reduced. Moreover, said plan enables the control of the rate of flow of the liquid fluid to different refrigerative loads without changing the ratio between the main and subsidiary streams.

Thus, there are good reasons to conclude that the disclosed method of producing supercold temperature offers in various its embodiments a number of advantages when said method is being realized in cryogenic systems.

Thanks to the improvements, described hereinabove, of the process taking place in the liquefaction stage there is a practical possibility to increase the refrigerating capacity of a system by a considerable amount or, if there is no need to boost the refrigerative capacity, to reduce the power requirements of the system both by expanding the main stream in the liquefaction stage with the removal of energy and by expanding through throttling.

In addition, this paves the way for an effective use of turbine expanders in the liquefaction stages with the result that the operational reliability of the system increases. Improved conditions under which the expander is bound to operate not only increase the reliability of the system but also add to its capacity.

If the refrigerating capacity needs no intensification, the method disclosed provides for reducing the size of the system, i.e., for making it more compact than a system employing the known method.

A further advantage of the method offered is the possibility of feeding the liquefied main stream and the liquefied portion of the subsidiary stream separately to sustain different refrigerative loads. When the system is used to sustain more than one refrigerative load, the number of distributing and regulating fittings can consequently be reduced, and the pressure of each stream can be controlled upstream of the load it sustains independently of the other stream.

Yet a further advantage of the method disclosed is simplified design of the liquefaction stage which is achievable owing to the merging of the main and subsidiary streams in this stage.

BRIEF DESCRIPTION OF THE DRAWINGS

Said features and other advantages of the present invention will be best understood from the following description of specific embodiments of the invention when this description is being read in conjunction with the accompanying drawings in which.

DETAILED DESCRIPTION

Figure 1:
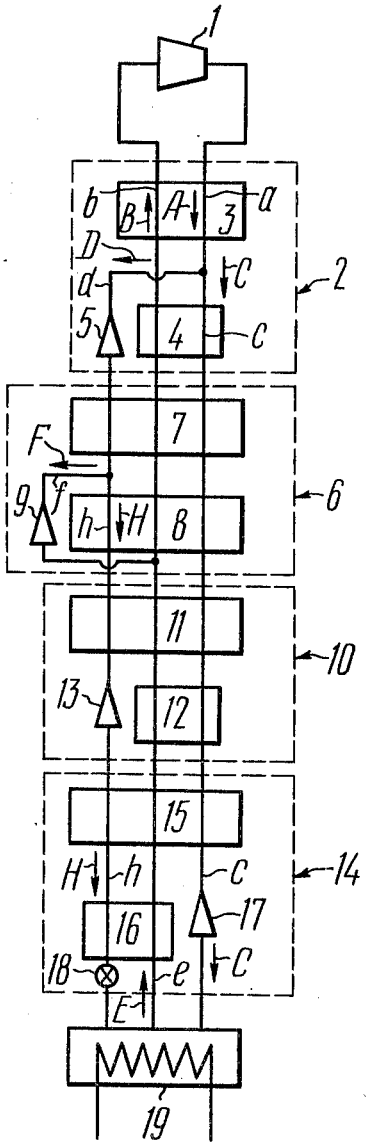
FIG. 1 is a schematic diagram of a cryogenic system realizing the method in accordance with the invention wherein the main stream is being liquefied in the liquefaction stage by expansion with the removal of energy while the subsidiary stream is being liquefied partially.

The disclosed method of producing supercold temperature in cryogenic systems is realized in accordance with the invention as follows.

A gaseous fluid, e.g., helium, is compressed in a compressor 1 (FIG. 1) at the ambient temperature to a pressure exceeding the critical pressure of the gaseous fluid several times so that an incoming stream "a" is formed, flowing in the direction indicated by arrow "A." The incoming tream "a" enters a first cooling stage 2 comprising heat exchangers 3, 4 and an expander 5 where it is cooled to an absolute temperature which is between ½ and ⅓ of the absolute temperature of the surrounding in the heat exchanger 3 by an expanded return stream "b" of the same fluid flowing in the direction indicated by arrow "B." On passing through the heat exchanger 3, the incoming stream "a" is split into a main stream "c" passing in the direction indicated by arrow "C" and a subsidiary stream "d" marked by arrow "D." The stream "d" is expanded in the expander 5 to a pressure which is between 67 and 50% of the initial pressure, said expansion being effected with the removal of energy. After that, the temperature of the stream "d" is reduced roughly by 10° to 20° K., and the main stream "c" is cooled to the same temperature by the return stream "b" in the heat exchanger 4. Thus, in the first cooling stage 2 the gaseous fluid, e.g., helium, is cooled to a certain temperature, and the losses incurred due to the irreversibility of the processes such as, for example, the process of heat transfer in the heat exchangers 3 and 4 where the difference between the temperatures of the streams is a few degrees—commonly around 5° K. in this stage—are compensated for by expanding the sunsidiary stream of the fluid with the removal of energy. The cooling of the compressed stream "c" along with making up for the losses due to irreversibility in the heat exchanger 4 are effected due to the fact that the mass of the stream "b" exceeds that of the stream "c."

After that the main stream "c" and the subsidiary stream "d" are introduced into the next, i.e., second cooling stage 6 comprising similar items of equipment which are heat exchangers 7, 8 and an expander 9. On being cooled in the heat exchanger 7, the stream "d" is split into a stream "f" flowing in the direction of arrow "F" and a stream "h" passing in the directions indicated by arrow "H." The stream "c" is fed for cooling into the heat exchangers 7 and 8, and the stream "d" is cooled also in the heat exchanger 7. The stream "f" is expanded in the expander 9 to the pressure of a return stream "e" which leaves a third cooling stage 10 and flows in the direction indicated by arrow "E" and, as a result, the stream "f" is cooled to the temperature which the stream "e" has at the exit from the third cooling stage 10.

In the third cooling stage 10 comprising heat exchangers 11, 12 and an expander 13, the main stream "c" is cooled while passing through the heat exchangers 11 and 12 whereas the stream "h," on being cooled in the heat exchanger 11, is expanded in the expander 13 to a pressure approaching the critical one which is 2.26 bars for helium. The temperature of the stream "h" lowers after this expansion, and the outflows of the streams "c" and "h" leave the third stage 10 at temperatures which differ but little one from another, being then fed into a liquefaction stage 14 comprising heat exchangers 15, 16, an expander 17 and a Joule-Thompson valve 18.

In the liquefaction stage 14, the main stream "c" is cooled by being passed through the heat exchanger 15 and then is expanded in the expander 17 to the pressure of the return stream "e" so that the stream "c" is liquefied. The stream "h," passing through the heat exchanger 15, is cooled therein along with the main stream "c" by the return stream "e." Since introduced into the liquefaction stage 14 are two incoming streams "c" and "h," the parameters of these streams i.e., pressure, rate of flow and temperature, at the inlet into the stage 14 can be controlled so as to assure a minimum difference between the temperatures of the incoming streams "c" and "h" and of the return streams "e." This provides for the possibility of utilizing surplus cold of the return stream "e" for the liquefaction of the stream "h" constituting a portion of the subsidiary stream "d," said liquefaction taking place in the heat exchanger 16 wherein the stream "h" is cooled and condensed due to the heat exchange with the stream "e." The process of liquefaction is possible because the rate of flow of the stream "h" is by far smaller of the rate of flow of the stream "e." On being condensed and cooled in the heat exchanger 16, the stream "h" is throttled through the Joule-Thompson valve 18 to the pressure of the return stream and liquefied in consequence. The resulting streams "h" and "c" of liquefied fluid are fed to sustain a refrigerative load 19, sbsorb a heat from the load and evaporate. The vapour outflow from the refrigerative load 19 forms the return stream "e" which passes through the stages 14, 10, 6 and 2 in the reverse direction, warms up, mixes with the expanded stream "f," forms the stream "b," warms up to the ambient temperature and is introduced into the compressor 1 for compression. This completes the cycle which is then repeated.

As it will be noted from the above description, subject to liquefaction and serving to sustain the refrigerative load 19 is the bulk (over 90%) of the fluid compressed in the compressor 1 and this provides for a substantial increase in the refrigerating capacity of the system.

The above embodiment of the present invention is now explained by reference to a specific example.

EXAMPLE 1

Helium admitted into the compressor 1 under a pressure of 1 bar is compressed to a pressure of 20 bars at a temperature of 300° K. to form the incoming stream "a" introduced into the heat exchanger 3 of the cooling stage 2 where it is cooled to a temperature of 105° K. by the return stream "b" flowing through the heat exchanger 3 in the reverse direction. On leaving the heat exchanger 3, the stream "a" is split into the main stream "c," constituting 61% of the incoming stream "a," and into the subsidiary stream "d" which is admitted into the expander 5 and expanded therein with the removal of energy to a pressure of 12 bars so that its temperature drops to 90° K. The stream "c" is cooled in the heat exchanger 4 by the return stream "b" to the same temperature.

In the second stage 6, the stream "c" and "d" are cooled to a temperature of 57° K. by being passed through the heat exchanger 7. Next, the stream "c" receives a further cooling in the heat exchanger 8 whereas a portion of the subsidiary stream "d," constituting the stream "f," is directed into the expander 9 wherein it is expanded to the pressure of the return stream with the removal of energy. The temperature of the stream "f" consequently lowers to 32.5, and approximately to the same temperature cooles the stream "c" in the heat exchanger 8.

In the third stage 10, the streams "c" and "h" are cooled to a temperature of 20° K. by being passed through the heat exchanger 11, and the stream "c" is further cooled to a temperature of 12° K. by being passed through the heat exchanger 12 whereas the outflow of the stream "h" from the heat exchanger 11 is fed into the expander 13 wherein it is expanded to a pressure of 2.1 bars with the removal of energy so that its temperature drops to 12° K.

In the liquefaction stage 14, the stream "c" is cooled to 5.75° K. by being passed through the heat exchanger 17 and expanded to a pressure of 1.4 bar in the expander 17 with the removal of energy so that liquid helium is formed which has a boiling point in the saturated condition corresponding to the pressure of the liquid and which contains no bubbles of vapour. The stream "h" is cooled to a temperature of 5.75° K. in the heat exchanger 15, condensed at a pressure of 2 bars and cooled to 4.7° K. in the heat exchanger 16, expanded through the Joule-Thompson valve 18 and fed to sustain the refrigerative load 19. The streams "c" and "h" of liquid helium formed account for 92% of the stream "a" leaving the compressor 1. They are fed to sustain the refrigerative load 19, vapourized as a consequence and the vapour formed is returned into the heat exchanger 16 in the form of the return stream "e" at a temperature of 4.5° K. and under a pressure of 1.3 bar. The return stream "e" is heated to 5.5° K. in the heat exchanger 16, to 12° K. in the heat exchanger 15 and then it is passed through the rest of the heat exchangers shown at 11, 8, 7, 4 and 3 in the reverse direction, leaving the heat exchanger 3 under a pressure of 1.03 bars and at a temperature of 295° K. to be admitted into the compressor 1 for compression. This completes the cycle.

Figure 2:
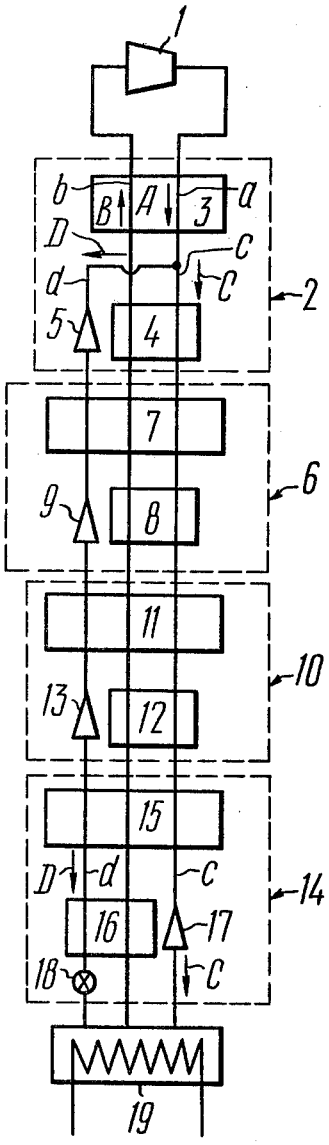
FIG. 2 is a view similar to FIG. 1, illustrating an embodiment of the invention wherein the subsidiary stream is being liquefied completely.

Consider the present invention in another embodiment illustrated in FIG. 2 wherein the entire subsidiary stream is being liquefied in the liquefaction stage.

At it will be noted from FIG. 2, in this case there are in accordance with the invention also three cooling stages 2, 6, 10 and a liquefaction stage 14, other numerals being the same as in FIG. 1. The process goes on in the same way as described above and will now be illustrated by reference to a specific example.

EXAMPLE 2

Gaseous helium is compressed in the compressor 1 from a pressure of 1 bar to a pressure of 25 bars to form the incoming stream "a" which is passed through the heat exchanger 3 of the stage 2 at a temperature of 300° K. in the direction indicated by arrow "A." In the heat exchanger 3, the stream "a" is being cooled to a temperature of 100° K. by the return stream "b" flowing in the reverse direction as indicated by arrow "B." The outflow of stream "a" from the heat exchanger 3 is split into the main stream "c" and the subsidiary stream "d," this latter stream constituting 33% of the stream "a." The stream "c" is cooled to a temperature of 5.9° K. in the heat exchangers 4, 7, 8, 11, 12 and 15 by the return stream "b" and expanded in the expander 17 to a pressure of 1.4 bar, liquefying in consequence. The stream "d" is expanded in the expander 5 to a pressure of 18 bars, said expansion being accompained by a decrease in the temperature to 90° K. After that the stream "d" is cooled to 41.9° K. in the heat exchanger 7 by the return stream "b" and expanded in the expander 9 to a pressure of 10 bars with the result that its temperature drops to 35° K. On being passed through the heat exchanger 11 wherein the temperature is lowered to 22.5° K., the stream "d" is expanded in the expander 13 to a pressure of 2.3 bars and is fed into the liquefaction stage 14 at a temperature of 15.3° K. In the liquefaction stage the process is continued in the same way as in Example 1, the outflow of the stream "d" from the heat exchanger 15 having a temperature of 5.9° K. and the temperature of the stream "b" at the outlet from the heat exchanger 16 being 5.6° K.

The described example of realizing the method disclosed offers an advantage which is that practically the entire helium which is being compressed in the compressor 1 is liquefied and fed to sustain the refrigerative load 19. This version provides for unitizing the turbine expanders 5, 9, 13 and for improving the conditions under which they are bound to operate.

Figure 3:
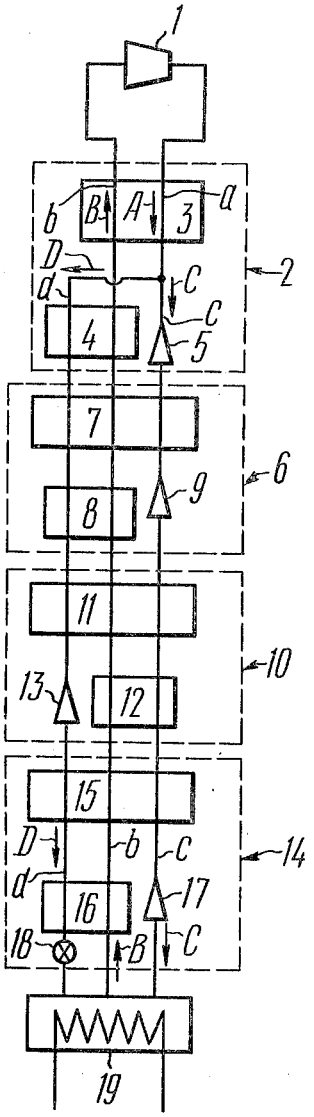
FIG. 3 is a view similar to FIG. 1, illustrating an embodiment of the invention wherein the pressure of the main stream is being reduced before introducing the stream into the liquefaction stage.

It is preferred that the pressure of the main stream "c" is reduced, as indicated in FIG. 3, by expanding in the cooling stage before the stream is introduced into the liquefaction stage 14, the liquefied streams "c" and "d" being then merged in the means of sustaining the refrigerative load 19. In this case, gaseous fluid is admitted under the pressure of the return stream "b," equalling to the atmospheric one, into the compressor 1 wherein it is compressed to a pressure exceeding the critical pressure of the fluid several times. The compressed fluid forms the incoming stream "a" fed at the ambient temperature, around 300° K., into the three successive cooling stages 2, 6, 10 and the liquefaction stage 14 comprising, by analogy with other versions heat exchangers and a means of expansion—an expander or a Joule-Thompson valve—along with the interconnecting lines, all these items of the equipment having the same reference numerals as in FIGS. 1 and 2.

The incoming stream "a," flowing in the direction indicated by arrow "A," passes through the heat exchanger 2 wherein it is cooled by the return stream "b," flowing in the direction indicated by arrow "B," to a temperature of roughly 100° K. and then is split into the main stream "c" and the subsidiary stream "d," flowing thence in the directions indicated by arrows "C" and "D," respectively. The two streams "c" and "d" are cooled in the successively arranged cooling stages 2, 6 and 10 in the same way as described hereinabove with the only exception that expanded in the expanders 5 and 9 is the main stream "c" whereas the subsidiary stream "d" is expanded only in the expander 13 on the third cooling stage 10. The pressure under which the stream "c" enters the liquefaction stage 14 is approximately ½ the pressure under which the compressed fluid leaves the compressor 1, and the stream "d" enters the liquefaction stage 14 under a pressure close to the critical one. The liquefaction of the incoming streams "c" and "d" takes place in the stage 14 exactly as described hereinabove.

The fact that the pressure of the stream "c" is reduced before the stream is being introduced into the liquefaction stage 14 not only improves the conditions under which the turbine expanders 5 and 9 are operating but also provides for the control of the rates of flow of the main stream "c" and the subsidiary one "d." This latter possibility provides for the liquefaction of the entire subsidiary stream "d" and is of use in supplying liquefied for sustaining different refrigerative loads.

The above will now be illustrated by reference to a specific example.

EXAMPLE 3

Helium, on being compressed in the compressor 1 from a pressure of 1 bar to a pressure of 25 bars, forms the incoming stream "a" fed in the direction indicated by arrow A in FIG. 3. The incoming stream "a" is admitted at a temperature of 300° K. into the first cooling stage 2 wherein it is passed through the heat exchanger 3 and cooled by the return stream "b" to a temperature of 165° K. After that, the incoming stream is split into the main stream which is the stream "c" fed to the expander 5 and into the subsidiary stream which is the stream "d," constituting 30% of the stream "a," cooled in the successively arranged heat exchangers 4, 7, 8 and 11 of the cooling stages 2, 6 and 10. On being expanded in the expander 5 to a pressure of 18 bars, the stream "c" is admitted into the second cooling stage 2 wherein the process goes on in the same way as in Examples 1 and 2. The stream "c" is expanded in the expander 9 from the pressure of 18 bars to a pressure of 12 bars with the result that its temperature is reduced from 40 to 35° K. When admitted into the cooling stage 10, the stream "c" is cooled to 8.5° K. in the heat exchangers 11 and 12 whereas the stream "d" is cooled to 18° K. Next, the stream "d" is expanded to a pressure of 2.1 bars in the expander 13 and fed into the liquefaction stage 14 at a temperature of 8.5° K. In the liquefaction stage 14, the streams "c" and "d" are cooled to 5.5° K. in the heat exchanger 15 and then the stream "c" is expanded to a pressure of 1.4 bar in the expander 17, liquefying in consequence. The stream "d" is cooled to 4.65° K. in the heat exchanger 16, condensing as a result. After that the stream is expanded through the Joule-Thompson valve 18 and fed to sustain the refrigerative load 19. On absorbing the heat from the refrigerative load, the streams "c" and "d" evaporize, forming the return stream "b" marked by arrow "B" which enters the liquefaction stage 14 at a temperature of 4.5° K., passes through all the heat exchangers shown at 16, 15, 12, 11, 8, 7, 4 and 3 in the reverse direction, warms up to a temperature of 290° K. and is admitted into the compressor 1 for compression. This completes the cycle.

Consider another way of realizing the method disclosed wherein the main stream is being expanded with liquefaction in the liquefaction stage without the removal of energy, i.e., by throttling.

Practiced in some instances for the sake of improving the reliability of the system is the expansion of fluid by throttling rather than the expansion in the expander 17. Since this impairs the performance of the system, the losses are compensated for by increasing the initial pressure. The total number of expanders remains unchanged, i.e., four, but the system consists in this case, as it will be noted from FIG. 4, of four cooling stages shown at 2, 6, 10, 14 and of a liquefaction stage 21. Incorporated into the cooling stages 2, 6, 10 and 14 are expanders 5, 9, 13 and 20, and in the liquefaction stage 21 the main stream "c" is expanded through Joule-Thompsons valves 23 and 26, liquefying as a consequence exactly in the same way as the subsidiary stream "d" which is being expanded through the valves 24 and 18.

This technique based on an increase in the pressure of the fluid downstream of the compressor 1 without changing the total number of expanders is four as in all preceeding cases makes it a practical possibility that the entire incoming stream compressed in the compressor 1 is liquefied and fed to sustain the refrigerative load 19. The above-mentioned will now be illustrated by reference to a specific example.

EXAMPLE 4

Figure 4:
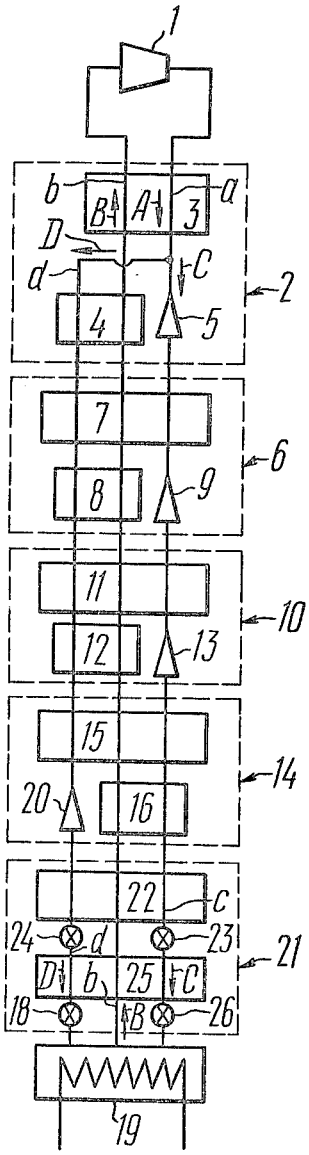
FIG. 4 is a view similar to FIG. 1, illustrating an embodiment of the invention wherein the main stream is being expanded with liquefaction in the liquefaction stage without the removal of energy, i.e., by throttling.

Referring to FIG. 4, helium is compressed in the compressor 1 from 1 bar to 31 bars and fed in the form of the incoming stream "a" at a temperature of 300° K. into the first cooling stage 2. By analogy with all the above-mentioned examples, the outflow of the stream "a" from the heat exchanger 3 is split at a temperature of 127° K. into the main stream "c" and the subsidiary stream "d."

The stream "c," constituting 75% of the stream "a," is expanded in the expander 5 to a pressure of 20 bars with the result that its temperature drops to 110° K., is further cooled to 47.8° K. by being passed through the heat exchanger 7 in the second cooling stage 6, expanded in the expander 9 to a pressure of 10 bars and fed into the heat exchanger 11 at a temperature of 40° K. The outflow from the heat exchanger 11 displaying a temperature of 27.5° K. is expanded in the expander 13 to a pressure of 4.2 bars and introduced, at a temperature of 21° K., into the next, i.e., fourth, cooling stage 14. In this stage, the stream "c" is cooled by the return stream "b" to a temperature of 5.75° K., this cooling taking place in the heat exchangers 15 and 16, and then the stream is fed to the liquefaction stage 21.

The stream "d" is cooled by the return stream "b" to a temperature of 8.5° K. in the heat exchangers 4, 7, 8, 11, 12 and 15, expanded in the expander 20 to a pressure of 3.8 bars and also fed into the liquefaction stage 21 at the temperature of 5.75° K.

In the liquefaction stage 21, the streams "c" and "d" are cooled to 5.1° K. by being passed through the heat exchanger 22, expanded through the Joule-Thompson valves 23 and 24, respectively, so that their pressure is 2.1 bars, cooled to a temperature of 4.7° K. in the heat exchanger 25, expanded through the valves 23 and 18, respectively, to a pressure of 1.4 bar and are fed in liquefied form to sustain in the refrigerative load 19. The outflow of vaporized helium leaving the refrigerative load 19 under a pressure of 1.3 bar and at a temperature of 4.5° K. forms the return stream "b" which is passed through all the heat exchangers in the reverse direction indicated by arrow "B," warms up therein to 295° K. and is admitted into the compressor 1 for compression. This completes the cycle.

It is preferred that the liquefied portion of the subsidiary stream is merged with the main stream before being introduced into the liquefaction stage.

The practicability of this way of realizing the invention is evident from considering in detail the values of parameters of the main and subsidiary streams at the outlet from the fourth cooling stage 14 in FIG. 4. There, the streams "c" and "d" have the same temperature and their pressures are close to each other, being 4.2 bars and 3.8 bars, respectively. If the expansion taking place in the expanders 13 and 20 of FIG. 4 results in the same pressure which is 4 bars, then the characteristic of the process in the liquefaction stage 21 of FIG. 4 remains unchanged. This case is represented in FIG. 5.

Figure 5:
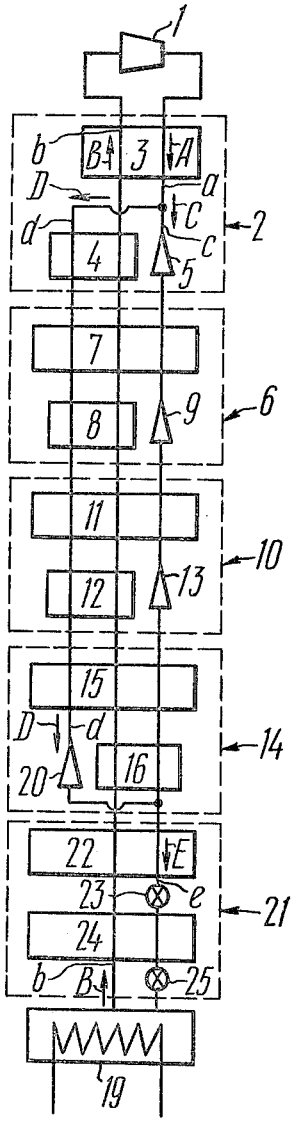
FIG. 5 is a view similar to FIG. 1, illustrating an embodiment of the invention wherein that portion of the subsidiary stream which is being liquefied is merged with the main stream before this stream is introduced into the liquefaction stage.

In realizing the invention as illustrated in FIG. 5, the process goes on exactly in the same way as this illustrated in FIG. 4 except that the streams "c" and "d" have the same pressure at the inlet into the liquefaction stage 21 of FIG. 5 and that they are merged downstream of the heat exchanger 16 and the expander 20 into the stream "e," the direction whereof is indicated by arrow "E," which is fed to sustain the refrigerative load 19. Since the rate of flow of the stream "e" is the same as that of the stream "a", use is made of just two valves instead of the four valves indicated in FIG. 4, simplifying thereby the design of the system. The above will now be illustrated by the following example.

EXAMPLE 5

Since the process taking place in all four cooling stages 2, 6, 10 and 14 of FIG. 5 is the same as the process referred to in Example 4 and illustrated in FIG. 4, its description is omitted. The only difference consists in that the pressure of the main stream "c" at the outlet from the heat exchanger 16 and that of the subsidiary stream "d" at the outlet from the expander 20 is the same, equalling 4 bars. On merging these streams into the stream "e," this stream is admitted into the liquefaction stage 21 at a temperature of 5.75° K. In the liquefaction stage 21, the composite stream "e" is cooled to 5.1° K. in the exchanger 22, expanded to a pressure of 2.1 bars through the valve 23, cooled and condensed in the heat exchanger 24, again expanded to a pressure of 1.4 bar through the valve 25 and fed to sustain the refrigerative load 19.

The return stream "b," leaving the refrigerative load 19 at a temperature of 4.5° K. and under a pressure of 1.3 bar, is passed through all the heat exchangers in the reverse direction, warms up therein to a temperature of 295° K. and is then admitted into the compressor 1 for compression. This completes the cycle.

The above examples indicate that the recourse to throttling of the main portion of the incoming stream as an alternative to the expansion thereof with liquefaction in an expander is conducive, in realizing the invention disclosed, to the liquefaction of almost 100% of the fluid compressed in the compressor, the pressure of the fluid being around 30 bars.

Figure 6:
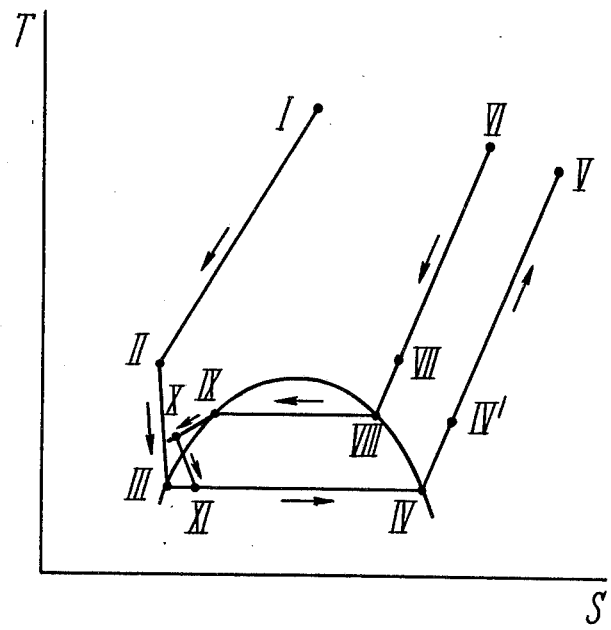
FIG. 6 is a temperature-entropy diagram of the main processes taking place in the liquefaction stage when the invention is being realized as indicated in FIGS. 1, 2 and 3.

The advantages offered by the method disclosed in that its version wherein the expansion of the main stream "c" takes place in the liquefaction stage with the removal of energy are illustrated in FIG. 6 which is a temperature-entropy diagram of the process occuring in the liquefaction stage. The direction wherein the process proceeds is indicated by arrows.

On being cooled in the cooling stages to the temperature given by point 1, the main stream is admitted into the liquefaction stage under the pressure which, being by far higher of the critical one, corresponds to the pressure at point 1. Admitted along with the main stream into the liquefaction stage is the subsidiary stream which has been expanded to a pressure corresponding to the pressure at point VI, exceeding the pressure of the return stream, and cooled down to the temperature at point VI, equalling to that at point 1, in the cooling stages. Both these streams are cooled by the return stream to the same temperature at points II and VII, respectively, while their pressure remains constant. The return stream warms up in consequence from the temperature at point IV' to the temperature at point V. Since the pressures and masses of the streams are so selected that the aggregate heat capacity of the incoming streams approaches the heat capacity of the return stream over the entire range of temperatures, the difference between the temperatures of the incoming and return streams is sufficiently small, being determined only by the efficiency of the heat exchanger. Practically, this difference is 0.1 to 0.3° K. and is given by the difference between the ordinates of the points I and V, VI and V, II and IV', VI and IV' in FIG. 6.

The main stream cooled along line I–II to a temperature of about 6° K. is removed from the process of heat transfer and expanded in the expander with the removal of energy to the pressure of the return stream along line II–III. This results in the liquefaction of helium at a boiling point corresponding to the pressure of the return stream. The liquefied helium is fed to sustain the refrigerative load, evaporating in consequence along line III–IV, and then returns into the liquefaction stage in the form of vapour at a temperature of about 4.5° K. The temperature and entropy of the vapour are given by point IV.

The subsidiary stream cooled to the temperature at point VII is further cooled along line VII–VIII due to the heat transfer with the return stream, condensed along line VIII–IX and again cooled to the temperature at point X. After that, the stream is throttled along line X–XI and liquefied in consequence almost completely, being then fed to sustain the refrigerative load where it evaporates along line XI–IV. The return stream warms up along line IV–IV′ to a temperature of about 5.5° K. due to heat transfer.

The above temperature-entropy diagram provides an insight into the advantages of the disclosed invention which can be summarized as follows. By virtue of the fact that the subsidiary stream is being introduced into the liquefaction stage under a pressure approaching the critical one it is possible to minimize the difference between the temperatures of the return stream and both incoming streams, the main and subsidiary. This enables a wastless utilization of surplus cold contained in the return stream at the temperature level corresponding to points IV and IV′ for the liquefaction of the subsidiary stream with the result that the amount of liquefied fluid fed to sustain the refrigerative load increases and so does the refrigerating capacity of the system. In the known methods of producing supercold temperature, said reserve of refrigerating capacity is dissipated, mainly by incurring a gain in entropy.

The realization of the method disclosed in a pilot cryogenic system has proved an increase in the refrigerating capacity of the system from 320 to 480 W,i.e., by 50%.

What is claimed is:

1. A method of producing supercold temperature in cryogenic systems comprising compressing a gaseous fluid constituting an incoming stream; stepwise cooling the incoming stream by a return stream of said gaseous fluid; splitting the incoming stream into a main stream and a subsidiary stream in the course of the stepwise cooling of said incoming stream; expanding the subsidiary stream which is used to compensate for the losses in the system, said expansion being effected with the removal of energy; expanding the main stream to effect its liquefaction in a liquefaction stage; introducing at least a portion of the subsidiary stream into the liquefaction stage after expanding said subsidiary stream with the removal of energy; liquefying at least a portion of the subsidiary stream in the liquefaction stage; and feeding the liquid fluid formed from the main and subsidiary streams to sustain a refrigerative load where the fluid is transformed into vapor constituting said return stream which is passed through the liquefaction stage and the cooling stages in the reverse direction.

2. A method of producing supercold temperature in cryogenic systems as claimed in claim 1, wherein the main stream is expanded, before being introduced into the liquefaction stage, to a pressure at least equal to the critical pressure of the gaseous fluid and then the main stream is merged with that portions of the subsidiary stream which is fed into said liquefaction stage.

* * * * *